US009563167B2

(12) United States Patent
Tomita et al.

(10) Patent No.: US 9,563,167 B2
(45) Date of Patent: Feb. 7, 2017

(54) IMAGE FORMING APPARATUS PERFORMING A CORONA PRODUCTS REMOVAL MODE

(71) Applicants: Daisuke Tomita, Kanagawa (JP); Toshiya Satoh, Kanagawa (JP); Norio Kudoh, Kanagawa (JP); Hiroyuki Uenishi, Kanagawa (JP); Tomohiko Saito, Ibaraki (JP)

(72) Inventors: Daisuke Tomita, Kanagawa (JP); Toshiya Satoh, Kanagawa (JP); Norio Kudoh, Kanagawa (JP); Hiroyuki Uenishi, Kanagawa (JP); Tomohiko Saito, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/016,372

(22) Filed: Feb. 5, 2016

(65) Prior Publication Data

US 2016/0231689 A1 Aug. 11, 2016

(30) Foreign Application Priority Data

Feb. 5, 2015 (JP) ..... 2015-020845

(51) Int. Cl.
*G03G 15/00* (2006.01)
*G03G 21/00* (2006.01)

(52) U.S. Cl.
CPC ..... *G03G 21/00* (2013.01)

(58) Field of Classification Search
USPC ..... 399/38, 42–44, 46, 71, 91, 97, 343, 353
See application file for complete search history.

(56) References Cited

U.S. PATENT DOCUMENTS

| | | | | |
|---|---|---|---|---|
| 8,934,822 | B2 * | 1/2015 | Mimbu | G03G 15/168 399/314 |
| 2007/0212139 | A1 * | 9/2007 | Sugiura | G03G 21/0035 399/353 |
| 2012/0328332 | A1 | 12/2012 | Kosuge et al. | |
| 2013/0243486 | A1 | 9/2013 | Satoh | |
| 2014/0270847 | A1 | 9/2014 | Uenishi et al. | |

FOREIGN PATENT DOCUMENTS

| | | |
|---|---|---|
| JP | 9-080998 | 3/1997 |
| JP | 2002-082573 | 3/2002 |
| JP | 2002-123144 | 4/2002 |
| JP | 2011-102837 | 5/2011 |

* cited by examiner

*Primary Examiner* — Hoan Tran
(74) *Attorney, Agent, or Firm* — Oblon, McClelland, Maier & Neustadt, L.L.P.

(57) ABSTRACT

An image forming apparatus includes an image bearer; a charger to charge a surface of the image bear; a developing device to develop a toner image on the surface of the image bearer; an image bearer cleaner to remove residual toner remaining on the surface of the image bearer after a transfer process; and a controller to cause the image forming apparatus to perform, before a start of printing operation, a corona products removal mode. In the image forming apparatus further including a temperature and humidity sensor to measure temperature and humidity of an ambient environment of the image bearer, the controller to cause the image forming apparatus to perform, before a start of an image forming operation, a corona products removal mode based on an absolute humidity obtained by the temperature and humidity detected by the temperature and humidity sensor.

17 Claims, 7 Drawing Sheets

FIG. 3

| | | STANDBY TIME FROM END OF PRINTING TO START OF NEXT PRINTING | | | |
|---|---|---|---|---|---|
| | | 0 TO 30 MIN | 30 TO 60 MIN | 1 TO 2 HOURS | 2 HOURS OR LONGER |
| NUMBER OF PRINTS [kP] | 0 TO 400 | CORONA PRODUCTS REMOVAL MODE NOT PERFORMED | NORMAL MODE × 1 | NORMAL MODE × 2 | NORMAL MODE × 4 |
| | 400 TO 1200 | CORONA PRODUCTS REMOVAL MODE NOT PERFORMED | ENHANCED MODE × 1 | ENHANCED MODE × 2 | ENHANCED MODE × 4 |

FIG. 5

| | | STANDBY TIME FROM END OF PRINTING TO START OF NEXT PRINTING | | | |
|---|---|---|---|---|---|
| | | 0 TO 30 MIN | 30 TO 60 MIN | 1 TO 2 HOURS | 2 HOURS OR LONGER |
| ABUSOLUTE HUMIDITY [g/m$^3$] | 13 TO 16 | – | NORMAL MODE × 1 | NORMAL MODE × 2 | NORMAL MODE × 4 |
| | 16 OR HIGHER | – | ENHANCED MODE × 1 | ENHANCED MODE × 2 | ENHANCED MODE × 4 |

FIG. 8

| | | STANDBY TIME FROM END OF PRINTING TO START OF NEXT PRINTING | | | |
|---|---|---|---|---|---|
| | | 0 TO 5 MIN | 5 TO 30 MIN | 30 TO 60 MIN | 2 HOURS OR LONGER |
| NUMBER OF PRINTS AFTER PHOTO-CONDUCTOR REFRESHMENT [kP] | 0 TO 5 | 0 SEC | 0 SEC | 0 SEC | 30 SEC |
| | 5 TO 10 | 0 SEC | 10 SEC | 30 SEC | 60 SEC |
| | 10 TO 20 | 10 SEC | 20 SEC | 45 SEC | 90 SEC |
| | 20 TO 50 | 15 SEC | 30 SEC | 60 SEC | 120 SEC |
| | 50 TO 100 | 20 SEC | 40 SEC | 90 SEC | 180 SEC |
| | 100 OR MORE | 30 SEC | 60 SEC | 120 SEC | 240 SEC |

IMAGE FORMING APPARATUS PERFORMING A CORONA PRODUCTS REMOVAL MODE

CROSS-REFERENCE TO RELATED APPLICATION

The present application claims priority pursuant to 35 U.S.C. §119(a) from Japanese patent application number 2015-020845, filed on Feb. 5, 2015, the entire disclosure of which is incorporated by reference herein.

BACKGROUND

Technical Field

The present invention relates to an image forming apparatus, and more particularly, to removal of corona products in the image forming apparatus.

Related Art

Image forming processes performed in an image forming apparatus employing the electrophotographic method include, for example, (1) charging a surface of the photoconductor by a charging member such as a charger or a charging roller; (2) forming a predetermined electrostatic latent image on the surface of the photoconductor with an LD or LED, and discharging the surface of the photoconductor; (3) developing the latent image on the discharged portion on the photoconductor with toner by a developing device to render the latent image visible; (4) transfer the written toner image on a transfer member such as an intermediate transfer belt or a sheet of paper; and (5) fixing the toner image onto the sheet of paper by a fixing device.

In the above transfer process (4), residual toner remaining on the photoconductor not transferred from the photoconductor to the transfer member is collected and removed by a cleaner, so that the residual toner does not adversely affect subsequent image processes.

SUMMARY

In one embodiment of the disclosure, provided is an optimal image forming apparatus that includes an image bearer; a charger to charge a surface of the image bear; a developing device to develop a toner image on the surface of the image bearer; an image bearer cleaner to remove residual toner remaining on the surface of the image bearer after a transfer process; and a controller to cause the image forming apparatus to perform, before a start of printing operation, a corona products removal mode.

In another embodiment of the disclosure, provided is an optimal image forming apparatus that includes an image bearer; a charger to charge a surface of the image bear; a developing device to develop a toner image on the surface of the image bearer; an image bearer cleaner to remove residual toner remaining on the surface of the image bearer after a transfer process; a temperature and humidity sensor to measure temperature and humidity of an ambient environment of the image bearer; and a controller to cause the image forming apparatus to perform, before a start of an image forming operation, a corona products removal mode based on an absolute humidity obtained by the temperature and humidity detected by the temperature and humidity sensor.

In another and further embodiment of the disclosure, provided is an optimal image forming apparatus that includes an image bearer; a charger to charge a surface of the image bear; a developing device to develop a toner image on the surface of the image bearer; an image bearer cleaner to remove residual toner remaining on the surface of the image bearer; and a controller to determine a condition for the image forming apparatus performing a corona products removal mode based on a number of prints fed to the image bearer from a previous performing time of the corona products removal mode to another performing time of the corona products removal mode, and cause the image forming apparatus to perform the corona products removal mode.

These and other objects, features, and advantages of the present invention will become apparent upon consideration of the following description of preferred embodiments of the present invention when taken in conjunction with the accompanying drawings.

BRIEF DESCRIPTION OF THE DRAWINGS

FIG. 3 is a control table of a corona products removal mode according to the first embodiment of the present invention;

FIG. 5 is another control table of the corona products removal mode according to the second embodiment of the present invention;

FIG. 8 is another and further control table of the corona products removal mode according to the third embodiment of the present invention.

DETAILED DESCRIPTION

Figure 1:
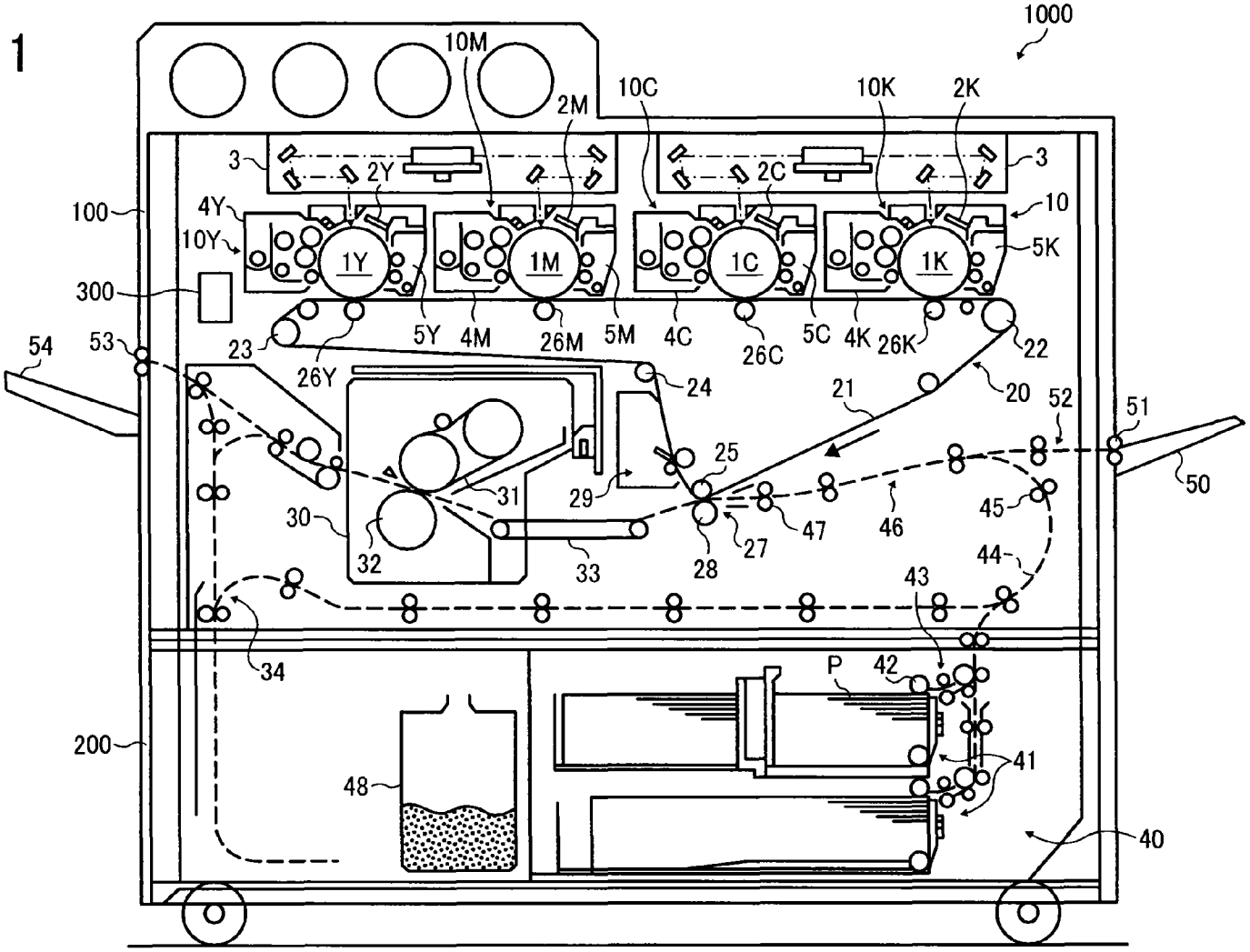
FIG. 1 schematically illustrates an image forming apparatus having a corona products removing structure.

In a charging process in the image forming processes, when the charger charges in air, corona products are generated and adhere to an image bearer, resulting in an abnormal image. To remove such corona products, a structure to remove the corona products via a pressing member such as a cleaning blade or a corona products removing roller is known. In addition, a method of providing toner between the cleaning blade and the image bearer to cause the surface of the image bearer to be abraded due to rolling resistivity of the toner, to thereby refresh the surface of the image bearer, is known. Further, a sensor to measure electrical potential on the surface of the image bearer, determine a level of adherence of the corona products, and determine whether the surface of the image bearer should be refreshed, is known.

However, provision of a dedicated corona products remover that contacts the photoconductor constantly accelerates abrasion of the photoconductor and drastically reduces the lifetime of the photoconductor image bearer unexpectedly. Furthermore, addition of the member increases the size and cost of the entire apparatus.

In addition, the method to refresh the surface of the image bearer by adhering the toner thereto after the corona products have adhered to the image bearer and an abnormal image has occurred will cause an abnormal image to occur as a matter of course. Thus, the surface of the image bearer must be refreshed, posing an additional burden to the user.

Further, measuring the electrical potential on the surface of the image bearer and determining a level of adherence of the corona products, members to measure the surface potential need to be disposed in the main scanning direction of the image bearer seamlessly, which increases parts cost and makes the entire apparatus larger.

There are methods that use the toner and the cleaning blade to remove the corona products. However, the need to refresh the surface of the image bearer still remains. In addition, the removal of the corona products is performed after the abnormal image has occurred, which is a problem.

The present invention aims to provide an image forming apparatus capable of removing corona products without conscious of the user and with a low cost.

More specifically, the present invention relates to an image forming apparatus including image forming units. Each of the image forming units includes an image bearer on the surface of which corona products may accumulate. The accumulated corona products need be removed. To remove the corona products adhered on the image bearer, a control table is provided to adhere toner onto the image bearer, to regulate environmental conditions to adhere the toner to the image bearer, frequencies of the adhesion, and an amount of the toner to be adhered to the image bearer.

First Embodiment

Hereinafter, preferred embodiments of the present invention will be described with reference to accompanying drawings. It should be noted that the term "printing" in the present embodiment includes not only printing but a variety of different types of image formation.

FIG. 1 schematically illustrates an image forming apparatus 1000 or a printer having a corona products removal structure. As illustrated in FIG. 1, the present printer includes an image forming section 100 to form an image on a transfer sheet P serving as a recording medium, and a sheet feed section 200 to supply the transfer sheet P to the image forming section 100. The image forming section 100 includes four image forming units 10Y, 10M, 10C, and 10K to form a toner image of respective colors of yellow (Y), magenta (M), cyan (C), and black (K). Hereinafter, affixes of Y, M, C, and K represent each color of yellow, magenta, cyan, and black. Each image forming unit 10Y, 10M, 10C, or 10K includes each photoconductor 1Y, 1M, 1C, or 1K, respectively, that bears a toner image of each color. Around each photoconductor 1, each charger 2Y, 2M, 2C, or 2K to uniformly charge a surface of each photoconductor 1, and a developing device 4Y, 4M, 4C, or 4K to develop the electrostatic latent image formed on the surface of each photoconductor 1, are disposed. In addition, around each photoconductor 1, each photoconductor cleaner 5Y, 5M, 5C, or 5K to clean the surface of the photoconductor 1 after transferring the toner image, and a lubricant applicator 6 (see FIG. 2) to coat the lubricant on the surface of each photoconductor 1, are disposed.

Above the image forming units 10Y, 10M, 10C, and 10K, disposed are optical writing units 3 to irradiate the uniformly charged surface of each photoconductor 1M, 1C, 1Y, or 1K with laser beams corresponding to image data, to thereby form an electrostatic latent image thereon. Each optical writing unit 3 includes a laser light source, a polygon mirror, f-θ lens, and a reflection mirror, and irradiates laser beams, while scanning in a main scanning direction, on the surface of the photoconductor 1Y, 1C, 1Y, or 1K driven to rotate based on each image data at a predetermined exposure position.

Below the image forming units 10Y, 10M, 10C, and 10K, disposed is a transfer unit 20 to transfer a toner image formed on each of the photoconductors 1Y, 1M, 1C, and 1K via an intermediate transfer belt 21 serving as an intermediate transfer member, to the transfer sheet P. In the transfer unit 20, an endless-belt shaped transfer belt 21 is wound around a plurality of support rollers 23, 24, and 25 including a drive roller 22, and is driven to rotate in the counterclockwise direction at a predetermined timing. Primary transfer rollers 26Y, 26M, 26C, and 26K disposed on an interior surface of the transfer belt 21 each apply transfer electrical potential at a primary transfer position, to thereby transfer the toner image on each of the photoconductors 1Y, 1M, 1C, and 1K to the intermediate transfer belt 21. In addition, the transfer unit 20 includes a secondary transfer device 27 disposed opposite the image forming unit 10 with the intermediate transfer belt 21 sandwiched in between. The secondary transfer device 27 presses a secondary transfer roller 28 against a secondary transfer opposite roller 25 via the intermediate transfer belt 21, to thereby impress a transfer electric field, so that the toner image formed on the intermediate transfer belt 21 is transferred to the transfer sheet P. In addition, a belt cleaner 29 to remove residual toner remaining on the intermediate transfer belt 21 after toner image transfer to the transfer sheet P, is disposed between the support roller 24 and the secondary transfer opposite roller 25.

A fixing device 30 to fix a toner image transferred on the transfer sheet P is disposed on the left of the transfer unit 20 in FIG. 1. The fixing device 30 is configured to press the fixing belt 31 against a pressure roller 32, to thereby fix the toner image on the transfer sheet P with heat and pressure. In addition, a conveyance belt 33 to convey the transfer sheet P to the fixing device 30 is disposed between the secondary transfer device 27 and the fixing device 30. Below the transfer unit 20, a sheet reversing device 34 to reverse the transfer sheet P to record both sides of the transfer sheet P is disposed in parallel to the image forming units 10Y, 10M, 10C, and 10K.

The sheet feed section 200 includes a plurality of paper trays 41 in a paper bank 40, each paper tray to contain a bundle of the plurality of transfer sheets P stacked therein, and a pair of sheet feed roller 42 is press-contacted to a topmost transfer sheet P in each of the paper trays 41. When the selected sheet feed roller 42 rotates in this state, the topmost recording sheet P is separated by a separation roller 43 and sequentially, each sheet P is sent to a sheet feed path 44. The transfer sheet P sent to the sheet feed path 44 is introduced to a sheet feed path 46 inside the image forming section 100 via a plurality of sheet feed roller pairs 45, and is sandwiched between rollers of a registration roller pair 47. The registration roller pair 47 once stops rotation of the two rollers upon the transfer sheet P is sandwiched between two rollers, resumes rotation at a predetermined timing, and sends the transfer sheet P toward the secondary transfer device 27.

In the printer configured as described above, image formation is performed as follows.

For example, as to the image forming unit 10Y for yellow color, a surface of the photoconductor 1Y uniformly charged by the corona charger 2Y is scanned and exposed by laser beams modified and deflected by one of the optical writing units 3, and an electrostatic latent image is formed on the surface thereof. The electrostatic latent image is rendered visible by the developing device 4Y as a yellow toner image. The toner image on the photoconductor 1Y is transferred to the intermediate transfer belt 21 at a primary transfer position opposite the primary transfer roller 26 with the intermediate transfer belt 21 sandwiched in between. The surface of the photoconductor 1Y after transferring the toner image is cleaned by the photoconductor cleaner 5Y, is coated with a lubricant by the photoconductor cleaner 5Y, and is ready for a next electrostatic latent image formation. The waste toner removed from the photoconductor 1Y is discharged to and is collected in the waste toner bottle 48 by a waste toner conveyance screw via a conveyance path, both not shown.

As to the other image forming units 10M, 10C, and 10K, the image forming process as described above as to the image forming unit 10Y is performed in synchronous with the move of the intermediate transfer belt 21. On the other hand, the transfer sheet P fed out from the paper tray 41 is sent out by the registration roller pair 47 at a predetermined timing, and is conveyed to a secondary transfer position. Alternatively, the transfer sheet P supplied from a manual tray 50 disposed on a side of the image forming section 100 is fed into a manual sheet feed path 52 by a sheet feed roller 51, is sent out by a registration roller pair 47 at a predetermined timing, and is conveyed to the secondary transfer device 27. Then, the transfer sheet P on which a full-color image is transferred en bloc is conveyed by the conveyance belt 33 to the fixing device 30 where the toner image is fixed onto the transfer sheet P, and the transfer sheet P is ejected by a sheet ejection roller pair 53, and is ejected to a sheet ejection tray 54. Alternatively, the transfer sheet P, on which the toner image is transferred, is switched over by a switching claw, and is conveyed by a sheet reversing device 34 again to the secondary transfer device 27. Then, a toner image is recorded on a backside thereof, and the transfer sheet P is discharged on the sheet ejection tray 54 by the sheet ejection roller pair 53. On the other hand, the intermediate transfer belt 21 after the toner image transfer is subjected to the residual toner removal by the belt cleaner 29, and is ready for the next image forming operation by the image forming unit 10. The waste toner removed from the intermediate transfer belt 21 is discharged to and is collected in the waste toner bottle 48 via the waste toner conveyance screw and the conveyance path, both disposed inside the belt cleaner 29.

The above image forming operation represents various processes performed in four-color superimposed full-color mode selected on a control panel. When the monochrome mode is selected on the control panel, the support rollers 23, 24, and 25 other than the drive roller 22 are moved, so that the photoconductors 1Y, 1M, and 1C are separated from the intermediate transfer belt 21 and formation of K-toner image alone can be formed on the intermediate transfer belt 21.

Figure 2:
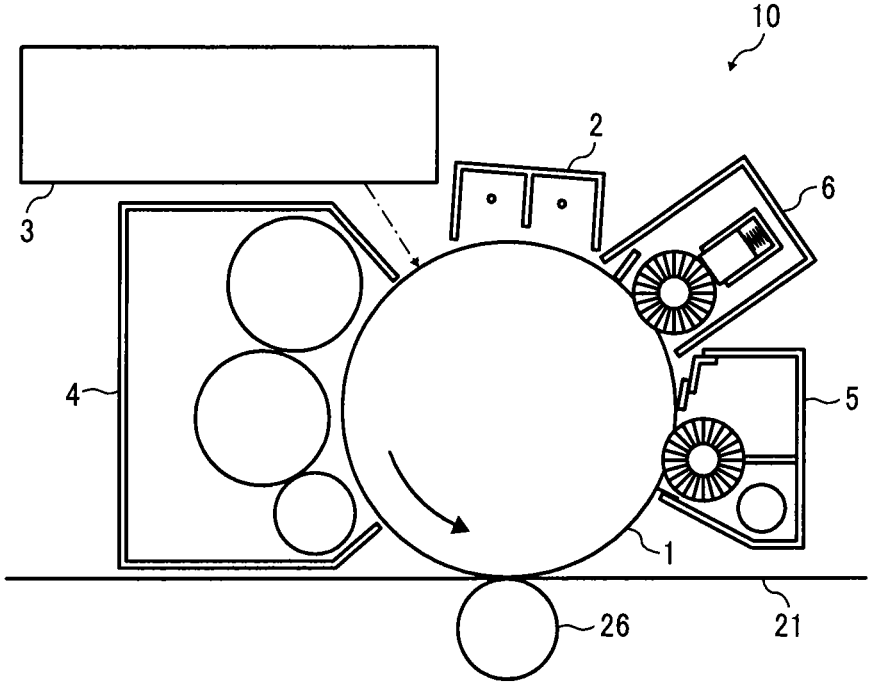
FIG. 2 is an enlarged partial view illustrating one of the image forming units and a peripheral part around the unit according to a first embodiment of the present invention.

FIG. 2 is an enlarged partial view illustrating one of the image forming units and a peripheral part thereof. Each image forming unit handles a different color of toner but is configured identical to every other; hence, the suffixes are omitted in the following description as appropriate. As illustrated in FIG. 2, each image forming unit 10 according to the present embodiment includes a photoconductor 1, and a corona charger 2, a developing device 4, a photoconductor cleaner 5, and a lubricant applicator 6 that are disposed around the photoconductor 1. The thus-formed image forming unit 10 is disposed as a process cartridge detachably attachable to the printer body. The thus-formed image forming unit 10 is configured as a process cartridge that is detachably attached to the printer body. In addition, in the image forming unit 10 according to the present embodiment, the photoconductor cleaner 5 and the lubricant applicator 6 may be integrally formed as simply illustrated in FIG. 1 with numerals 5Y, 5M, 5C, and 5K. Alternatively, the image forming unit 10 may be detached from the printer body and each of the photoconductor 1, the corona charger 2, the developing device 4, the photoconductor cleaner 5, and the lubricant applicator 6 may be removed separately from the image forming unit 10 for replacement with a new one.

After suspension of the image forming operation, inside the image forming section 100 of the image forming apparatus, corona products such as ozone, nitrogen oxide, nitric acid, and the like adhered to and accumulated on the corona charger 2 adhere to the surface of the photoconductor 1 disposed immediately below the corona charger 2 in the state of suspended rotation after the end of printing. Then, due to water absorbability, moisture in the air condenses and electrical resistance at the surface of the photoconductor 1 declines. In this case, when the latent image is formed on the surface of the photoconductor 1, a charge flows, thereby generating an abnormal image that is blurred or in which white spots appear. Further, when the corona products penetrate to the surface layer of the photoconductor 1 immediately below the corona charger 2, the electrostatic capacity increases, so that the surface potential of the subject part of the photoconductor decreases, thereby increasing density of the subject part in the formed image, and the black band appears.

Accordingly, to prevent adhesion of the corona products to the same area on the surface of the photoconductor 1, a control to perform the corona products removal mode is performed before the start of image forming operation.

FIG. 3 is a control table of a corona products removal mode explaining a control method performed by a controller 300. One such control table shows that a vertical column includes degrees of deterioration of the image bearer or the photoconductor 1 determined by the number of prints and a horizontal row includes standby time periods from the end of the previous printing to the start of next printing. The control table also includes toner input amounts when the corona products removal mode is performed. Herein, the standby time means a time period from when the photoconductor 1 stops after an end of printing to when the photoconductor 1 sets to operation or performs a subsequent printing. On or off of the power does not have any effect.

The corona products removal mode of the present embodiment includes two modes: a normal mode and an enhanced mode. The normal mode and the enhanced mode differ in the toner input amount to the photoconductor 1 per unit time. Codes and numbers such as "x1" to "x4" are coefficients to increase/decrease the time period performing the corona products removal mode to control an input amount of toner to the photoconductor 1.

The normal mode represents a case in which the toner adheres the photoconductor 1 slightly when the electrical potential of the developing device 4 and that of the photoconductor 1 are set to substantially identical (that is, a bias voltage is not applied to either), in which the toner adhesion amount on the photoconductor 1 is $1\times10^{-5}$ mg/mm$^2$ and the photoconductor 1 is caused to rotate during 60 seconds. The driving time period of the photoconductor 1 is changed using the above coefficients and the toner input amount to the photoconductor 1 is increased or decreased. In the above formula, 10 immediately before −5 represents a power root and −5 immediately after 10 represents an exponential number.

In addition, the enhanced mode causes a potential difference between the potential of the developing device 4 and that of the photoconductor 1 similar to the potential difference in image formation, and causes the same amount of toner as that of the solid image to be input to the photoconductor 1. The toner adhesion amount to the photoconductor 1 at that time is approximately $4.0\times10^{-3}$ mg/mm$^2$ to thereby rotate the photoconductor 1 over 60 seconds. As illustrated in FIG. 3, the corona products removal mode is automatically performed before the start of the printing operation, but preferably a manual mode is provided so that a user can perform such removal at any time. Various methods may be adopted therefor. It should be noted that reference numbers in FIG. 3 are simply examples and may be changed depending on the type of control.

According to the present invention, because a dedicated member need not be provided to handle the corona products, an abnormal image due to the corona products can be removed at a low cost and a smaller size of the apparatus before the user becomes conscious of the abnormal image due to the corona products. As described heretofore, the control table is generated based on the evaluation results concerning a combination of: environmental conditions, image bearer, and charging conditions to cause an abnormal image to occur due to adhesion of the corona products onto the surface of the photoconductor 1 as an image bearer, and the input amount of toner to remove the corona products. These conditions are made clear by the previous evaluation. Accordingly, by performing the corona products removal mode, the corona products can be appropriately removed.

In addition, the corona products removal mode according to the present embodiment causes the photoconductor 1 to rotate for a predetermined time period while supplying toner to the photoconductor 1 from the developing device 4. The time period for rotation is not limited to the above-described 60 seconds. Specifically, by providing a plurality of patterns for the execution period of the corona products removal mode, the toner amount can be controlled by the amount of the corona products. In addition, the corona products removal mode according to the present embodiment includes a mode to set the potential difference between the developing device 4 and the photoconductor 1 to zero or a very small level and another mode to set the potential difference between the aforementioned to several hundred volts. With this structure, the toner amount can be easily controlled by the amount of the corona products.

In addition, the corona products removal mode according to the present embodiment can be performed by combining as appropriate a potential difference segment and a control segment to switch the execution period of the corona products removal mode based on the accumulated number of prints from an early stage when the photoconductor 1 was initially used. If the photoconductor 1 is deteriorated due to aging, the amount of toner to be used for the corona products removal mode is increased, thereby improving the removal effect and performance. For example, the corona products removal mode can be so configured as to be performed strongly as the standby time increases by providing the control segment to switch the potential difference segment with the execution period of the corona products removal mode based on the standby time from the previous printing operation to the next printing operation.

Further, if the above corona products removal mode is automatically performed before the start of printing, the burden of the user is lightened. The corona products removal mode can be configured to be performed manually by the user at an appropriate timing either. In that case, the user can determine execution of the corona products removal mode by oneself depending on the image quality that the user demands, and the toner consumption can be reduced appropriately.

Second Embodiment

Figure 4:
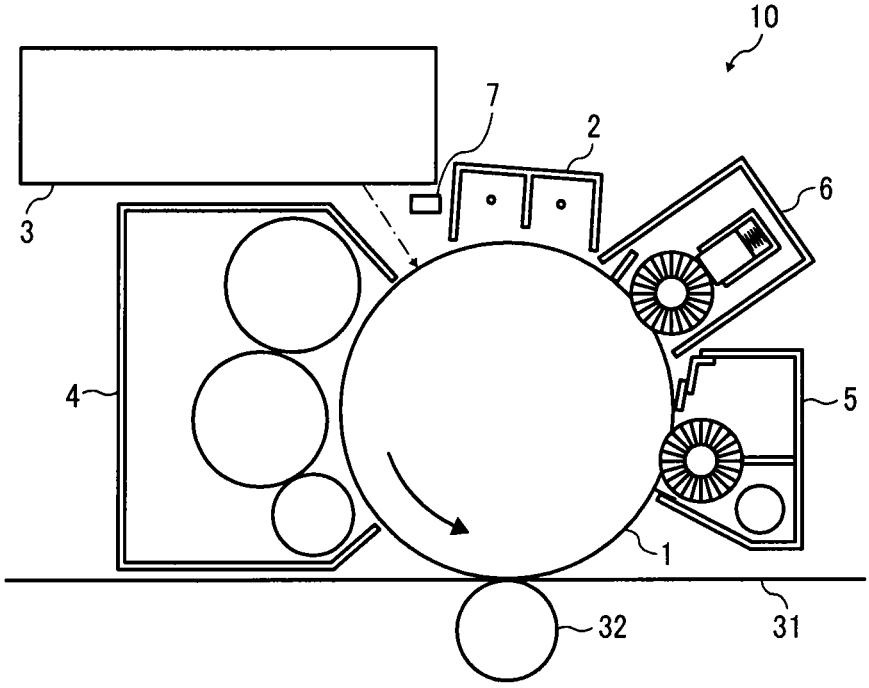
FIG. 4 is an enlarged partial view illustrating one of the image forming units of the image forming apparatus according to a second embodiment of the present invention.

FIG. 4 is an enlarged partial view illustrating one of the image forming units and peripheral part around the unit according to a second embodiment of the present invention. The second embodiment is different from the first embodiment as to provision of a temperature and humidity sensor 7. The temperature and humidity sensor 7 may be disposed at any place without limitation of the illustrated example as long as the place is suitable for measuring the temperature and humidity in the vicinity of the image forming unit 10 inside the image forming apparatus 1000.

FIG. 5 is another control table of a corona products removal mode including another type of control segments for the same mode performed by the controller 300. As illustrated in FIG. 5, the control table according to the present embodiment includes a vertical column showing absolute humidity of the environment in which the image bearer or the photoconductor 1 exists and a horizontal row showing standby time periods from the end of the previous printing to the start of next printing, and includes a toner input amount of the corona products removal mode at that time. Similarly to the first embodiment, the corona products removal mode of the present embodiment includes two versions: a normal mode and an enhanced mode. The normal mode and the enhanced mode differ in the toner input amount to the photoconductor 1 per unit time similarly to the first embodiment. Codes and numbers such as "x1" to "x4" are coefficients to change an input amount of toner to the photoconductor 1. Values in FIG. 5 are simply examples and may be changed at will.

The control in FIG. 5 is performed based on the absolute humidity alone. Herein, the absolute humidity is obtained based on the temperature and the relative humidity. Thus, the temperature and humidity sensor employed in the present embodiment can measure the temperature and the relative humidity. The absolute humidity in FIG. 5 means the volume absolute humidity.

As described above, also in the second embodiment, a dedicated member other than the temperature and humidity sensor 7 need not be provided to handle the corona products. According to the present invention, because a dedicated member need not be provided to handle the corona products, an abnormal image due to the corona products can be removed at a low cost and a smaller size of the apparatus before the user becomes conscious of the abnormal image due to the corona products. As described in the first embodiment, the control table is generated based on the evaluation results concerning the combination of: environmental condition, image bearer, and charging condition to cause an abnormal image to occur due to adhesion of the corona products onto the surface of the photoconductor 1 as an image bearer, and the input amount of toner to remove the corona products. These conditions are clarified based on the previous evaluation, and by performing the corona products removal mode, the corona products can be removed.

In addition, the corona products removal mode according to the present embodiment causes the photoconductor 1 to rotate for a predetermined time period while supplying toner to the photoconductor 1 from the developing device 4. The time period for rotation is not limited to the above-described 60 seconds. Specifically, by providing a plurality of patterns for the execution period of the corona products removal mode, the toner amount can be controlled by the amount of the corona products. In addition, the corona products removal mode according to the present embodiment includes a mode to set the potential difference between the developing device 4 and the photoconductor 1 to zero or a very small level and another mode to set the potential difference between the aforementioned to several hundred volts. With this structure, the toner amount can be easily controlled by the amount of the corona products.

Specifically, by providing a plurality of patterns for the execution period of the corona products removal mode, the toner amount can be controlled by the amount of the corona products. Further, the corona products removal mode can be so configured as to be performed strongly as the standby time increases by providing the control segment to switch the potential difference segment with the execution period of the corona products removal mode based on the temperature and humidity environment in which the photoconductor 1 exists. Preferably the amount of toner to be used for the corona products removal mode is increased as the absolute humidity increases, so that the removal effect and performance can be improved.

The corona products removal mode can be so configured as to be performed strongly as the standby time increases by providing the control segment to switch the potential difference segment with the execution period of the corona products removal mode based on the standby time from the previous printing operation to the next printing operation.

Further, if the above corona products removal mode is automatically performed before the start of printing, the burden of the user is lightened. The corona products removal mode can be configured to be performed manually by the user at an appropriate timing either. In that case, the user can determine execution of the corona products removal mode by oneself depending on the image quality that the user demands, and the toner consumption can be reduced appropriately.

Third Embodiment

The phenomenon in which the corona products accumulates on the surface of the photoconductor, to thereby cause to generate the abnormal image, frequently occurs when the photoconductor is left untouched for a relatively long time, such as over six hours. A photoconductor that is frequently used by the user every day, is shown to generate an abnormal image such as white dots due to a very short standby time, even five minutes of non-operational time. Then, preventive measures for the occurrence of the abnormal image due to the corona products are demanded depending on the frequencies of the user's printing operation by executing the job to remove the corona products on the image bearer.

In the present third embodiment, even the heavy user who prints mass printing volume can prevent abnormal images from occurring due to the corona products accumulation automatically before the user recognizes the abnormal image due to the corona products. Specifically, the image with white spots due to the corona products aggravates as the printing volume of the user increases. Accordingly, the control table is generated based on the number of prints since the surface of the image bearer has been refreshed lastly and the standby time after the suspension of the printing, and the corona products removal mode is performed based on the date of the control table, thereby appropriately removing the corona products.

In brief, the control table includes a mode to refresh the surface of the image bearer based on the number of prints after the surface of the image bearer was refreshed lastly and the standby time after the previous printing operation ended.

Figure 6:
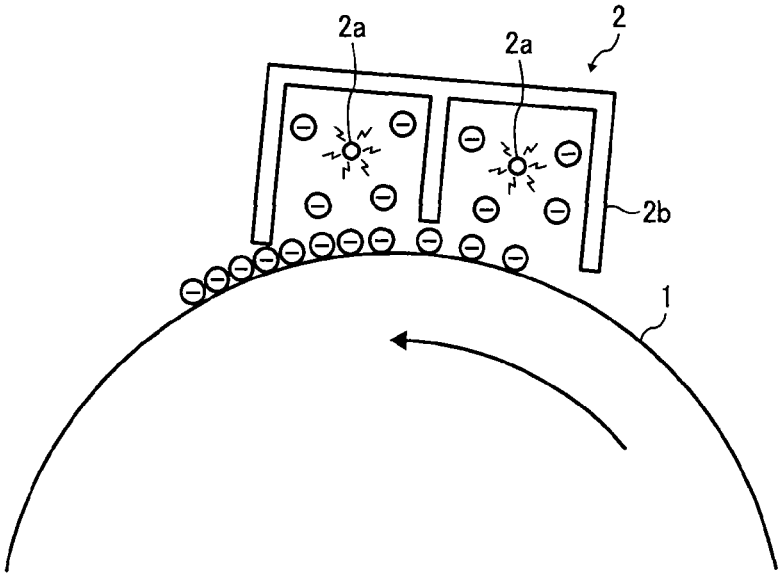
FIG. 6 illustrates a structure around a charger of the image forming unit in the image forming apparatus according to a third embodiment of the present invention.

FIG. 6 is a view illustrating a structure of the charger and therearound.

The corona charger 2 charges the photoconductor 1 with corona discharge, through which the corona products are generated, and adhere on the surface of the photoconductor 1 and a casing 2*b* disposed near a wire electrode 2*a* (or a grid electrode) of the corona charger 2. The corona products generated from the corona charger 2 are designed not to adhere on the surface of the photoconductor 1 due to an air flow near the corona charger 2, but part of the corona products adheres on the surface of the photoconductor 1. When the corona products adhere on the surface of the photoconductor 1 and while the photoconductor 1 is rotating, the surface of the photoconductor 1 is abraded due to friction resistance between the photoconductor cleaner 5 that cleans the residual toner after the transfer process and the photoconductor 1, so that the corona products adhered on the surface of the photoconductor 1 are removed.

However, in a state in which the printing operation ends and the photoconductor 1 stops, although the air continues to flow around the corona charger 2, part of the corona products falling down from the corona charger 2 adhere on the surface of the photoconductor 1 and accumulate thereon. After the printing operation has ended, because voltage is not applied to the corona charger 2, the corona products are not generated; however, the corona products generated before the start of the printing operation and adhered onto the casing 2*b* or wire electrode 2*a* of the corona charger 2 drop onto the photoconductor 1. As a result, the corona products gradually accumulate on the surface of the photoconductor 1.

Figure 7:
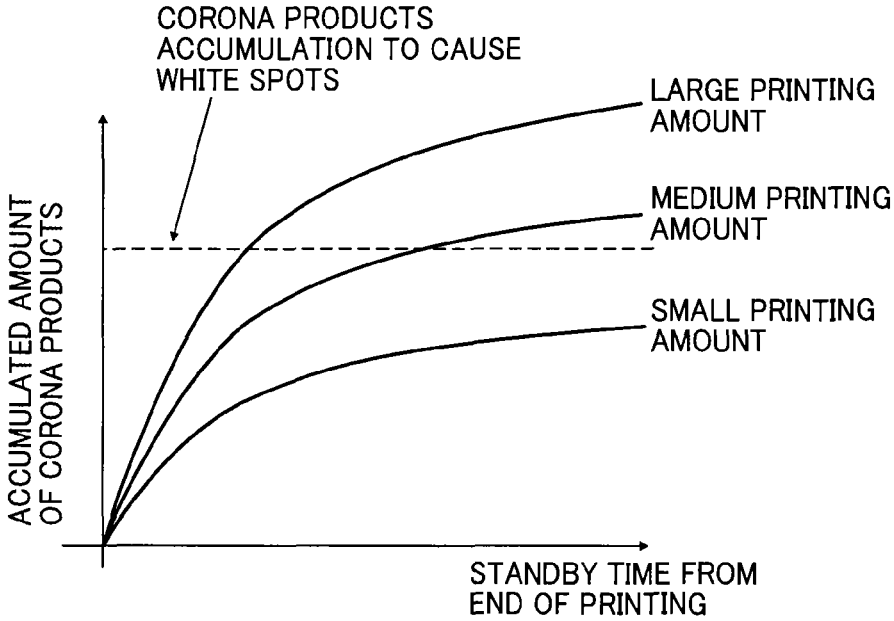
FIG. 7 illustrates a relation between a standby time (in which the printing operation is suspended) after an end of printing and the corona products accumulation on the surface of a photoconductor.

As described above, the amount of the corona products generated tends to decrease gradually from immediately after the printing operation has ended, and tends to saturate in a predetermined time later. However, the corona products accumulation on the image bearer increases further as the standby time becomes longer, so that the abnormal image tends to occur and the level of occurrence of the abnormal image gets worse (see FIG. 7). FIG. 7 illustrates a relation between a standby time (in which the printing operation is suspended) after an end of printing and the corona products accumulation on the surface of a photoconductor.

Specifically, the corona products on the photoconductor 1 can be removed from the surface of the image bearer by refreshing operation, but after the refreshing operation, the corona products gradually accumulate on the surface of the photoconductor 1. The accumulation continues during the printing operation after the refreshing operation. As a result, when the number of prints increases further after the refreshment of the photoconductor 1, the corona products on the surface of the image bearer tends to increase and the abnormal image occurs when the corona products exceed a certain amount.

FIG. 8 is another control table of a corona products removal mode including another type of control segments for the same mode performed by the controller 300. As illustrated in FIG. 8, the control table according to the present embodiment includes a vertical column showing the corona products accumulation on the surface of the image bearer of the photoconductor 1 (controlled by the number of prints), and a horizontal row showing standby time periods from the end of the previous printing to the start of next printing, and sets a time period to perform the corona products removal mode in each condition where the vertical column intersects with the horizontal row.

As described above, the corona products removal mode according to the present embodiment relates to a control to determine a condition of the next corona products removal mode based on the number of prints from when the previous corona products removal mode has been performed until the next corona products removal mode operation. The corona products removal mode comprises a control to determine the condition for performing the next corona products removal mode based on the standby time from the end of the previous printing to the start of the next printing. The condition to perform the corona products removal mode can be based on the time period of the corona products removal mode, and the toner input amount to the photoconductor cleaner can be varied.

In the present third embodiment, the temperature and humidity sensor 7 to detect the absolute humidity is disposed near the photoconductor 1 inside the body of the image forming apparatus, and the determination of performing the corona products removal mode can be based on the detected value of the absolute humidity. Alternatively, the corona products removal mode can be set to perform based on the number of prints or the rotation distance of the photoconductor 1.

The present invention is not limited only to the aforementioned embodiments, but various modifications can be applied thereto by the engineer who belongs to the present technical field, within the scope of the present invention.

Additional modifications and variations of the present invention are possible in light of the above teachings. It is therefore to be understood that, within the scope of the appended claims, the invention may be practiced other than as specifically described herein.

What is claimed is:

1. An image forming apparatus comprising:

an image bearer;

a charger to charge a surface of the image bearer;

a developing device to develop a toner image on the surface of the image bearer;

an image bearer cleaner to remove residual toner remaining on the surface of the image bearer after a transfer process; and a controller to cause the image forming apparatus to perform, before a start of printing operation, a corona products removal mode to remove corona products on the surface of the image bearer, wherein, in the corona products removal mode, the image bearer is rotated over a predetermined time period while the developing device supplies toner to the image bearer.

2. The image forming apparatus according to claim 1, wherein the corona products removal mode comprises a plurality of modes, including a first mode to set a potential difference between the developing device and the image bearer to zero or substantially zero and a second de to set the potential difference between the developing device and the image bearer to several hundred volts.

3. The image forming apparatus according to claim 1, wherein the corona products removal mode comprises a plurality of patterns of performing time periods.

4. The image forming apparatus according to claim 1, wherein:

the corona products removal mode comprises a plurality of patterns of performing time periods and a plurality of modes, a first mode to set a potential difference between the developing device and the image bearer to zero or substantially zero and a second mode to set the potential difference between the developing device and the image bearer to several hundred volts; and the plurality of modes based on the potential difference and the plurality of patterns of the performing time periods are switched based on a standby time from a previous printing operation to a next printing operation.

5. The image forming apparatus according to claim 1, wherein:

the corona products removal mode comprises a plurality of patterns of performing time periods and a plurality of modes, a first mode to set a potential difference between the developing device and the image bearer to zero or substantially zero and a second mode to set the potential difference between the developing device and the image bearer to several hundred volts; and the plurality of modes based on the potential difference and the plurality of patterns of performing time periods are switched based on an accumulated number of prints from an initial use of the image bearer.

6. The image forming apparatus according to claim 1, wherein the corona products removal mode is automatically performed before a start of printing operation.

7. An image forming apparatus comprising:

an image bearer;

a charger to charge a surface of the image bearer;

a developing device to develop a toner image on the surface of the image bearer;

an image bearer cleaner to remove residual toner remaining on the surface of the image bearer after a transfer process;

a temperature and humidity sensor to measure temperature and humidity of an ambient environment of the image bearer; and a controller to cause the image forming apparatus to perform, before a start of an image forming operation, a corona products removal mode to remove corona products on the surface of the image bearer, based on an absolute humidity obtained from the temperature and humidity detected by the temperature and humidity sensor, wherein, in the corona products removal mode, the image bearer is rotated over a predetermined time period while the developing device supplies toner to the image bearer.

8. The image forming apparatus according to claim 7, wherein the corona products removal mode comprises a plurality of modes, including a first mode to set a potential difference between the developing device and the image bearer to zero or substantially zero and a second mode to set the potential difference between the developing device and the image bearer to several hundred volts.

9. The image forming apparatus according to claim 7, wherein the corona products removal mode comprises a plurality of patterns of performing time periods.

10. The image forming apparatus according to claim 7, wherein:

the corona products removal mode comprises a plurality of patterns of performing time periods and a plurality of modes, a first mode to set a potential difference between the developing device and the image bearer to zero or substantially zero and a second mode to set the potential difference between the developing device and the image bearer to several hundred volts; and the plurality of modes based on the potential difference and the plurality of patterns of the performing time periods are switched based on a standby time from a previous printing operation to a next printing operation.

11. The image forming apparatus according to claim 7, wherein:

the corona products removal mode comprises a plurality of patterns of performing time periods and a plurality of modes, a first mode to set a potential difference between the developing device and the image bearer to zero or substantially zero and a second mode to set the potential difference between the developing device and the image bearer to several hundred volts; and the plurality of modes based on the potential difference and the plurality of patterns of performing time periods are switched based on an accumulated number of prints from an initial use of the image bearer.

12. The image forming apparatus according to claim 7, wherein:

the corona products removal mode comprises a plurality of modes, a first mode to set a potential difference between the developing device and the image bearer to zero or substantially zero and a second mode to set the potential difference between the developing device and the image bearer to several hundred volts;

the corona products removal mode comprises a plurality of patterns of performing time periods; and the plurality of modes based on the potential difference and the plurality of patterns of the performing time periods are switched based on a temperature and humidity environment in which the image bearer exists.

13. An image forming apparatus comprising:

an image bearer;

a charge to charge a surface of the image bearer;

a developing device to develop a toner image on the surface of the image bearer;

an image bearer cleaner to remove residual toner remaining on the surface of the image bearer; and a controller to determine a condition for the image forming apparatus performing a corona products removal mode based on a number of prints fed to the image bearer from a previous performing time of the corona products removal mode to another performing time of the corona products removal mode, and cause the image forming apparatus to perform the corona products removal mode, wherein the controller determines a condition for performing the corona products removal mode based on a standby time from an end of printing operation to a start of a next printing operation, and causes the image forming apparatus to perform the corona products removal mode.

14. The image forming apparatus according to claim 13, wherein the controller determines a condition for performing the corona products removal mode based on a performing time period of the corona products removal mode.

15. The image forming apparatus according to claim 13, wherein the condition for performing the corona products removal mode comprises varying an input amount of toner to the image bearer cleaner.

16. The image forming apparatus according claim 13, further comprising a sensor to detect an absolute humidity around the image bearer, wherein the controller causes the image forming apparatus to perform the corona products removal mode based on a value of the absolute humidity detected by the sensor.

17. The image forming apparatus according to claim 13, wherein the controller causes the image forming apparatus to perform the corona products removal mode based on a number of prints by the image bearer or a rotation distance of the image bearer.

* * * * *